US005373302A

United States Patent [19]

Wu

[11] Patent Number: 5,373,302

[45] Date of Patent: Dec. 13, 1994

[54] DOUBLE-LOOP FREQUENCY SELECTIVE SURFACES FOR MULTI FREQUENCY DIVISION MULTIPLEXING IN A DUAL REFLECTOR ANTENNA

[75] Inventor: Te-Kao Wu, Rancho Palos Verdes, Calif.

[73] Assignee: The United States of America as represented by the Administrator of the National Aeronautics and Space Administration, Washington, D.C.

[21] Appl. No.: 126,144

[22] Filed: Sep. 23, 1993

Related U.S. Application Data

[63] Continuation of Ser. No. 909,501, Jun. 24, 1992, abandoned.

[51] Int. Cl.[5] ..... H01Q 19/14

[52] U.S. Cl. ..... 343/781 P; 343/781 CA; 343/909

[58] Field of Search ..... 343/781 P, 781 R, 781 CA, 343/840, 909, 753, 779, 837; H01Q 13/00, 15/00, 15/02

[56] References Cited

U.S. PATENT DOCUMENTS

| | | | |
|---|---|---|---|
| 3,231,892 | 1/1966 | Matson et al. | 343/909 |
| 3,271,771 | 9/1966 | Hannan et al. | 343/909 |
| 3,281,850 | 10/1966 | Hannan | 343/909 |
| 4,017,865 | 4/1977 | Woodward | 343/781 CA |
| 4,777,491 | 10/1988 | Bassi et al. | 343/781 CA |
| 4,814,785 | 3/1989 | Wu | 343/909 |
| 5,130,718 | 7/1992 | Wu et al. | 343/781 CA |
| 5,162,809 | 11/1992 | Wu | 343/909 |

FOREIGN PATENT DOCUMENTS

| | | | |
|---|---|---|---|
| 2518828 | 6/1983 | France | 343/781 CA |

OTHER PUBLICATIONS

V. D. Agrawal and W. A. Imbriale, "Design of a Dichroic Cassegrain Subreflector," IEEE Trans. on Antennas and Propogation, vol. AP-27, No. 4, pp. 446-473 Jul. 1979.

G. H. Schennum, "Frequency Selective Surfaces for Multiple Frequency Antennas," Microwave Journal, pp. 55-57, May 1973.

R. Mittra, C. H. Chan and T. Cwik, "Techniques for Analyzing Frequency Selective Surfaces-A Review," IEEE Proceedings, vol. 76, No. 12, pp. 1593-1613, Dec. 1988.

J. D. Vacchione, "Techniques for Analyzing Planar, Periodic Frequency, Selective Surface Systems," Chapter 3, Multiscreen Systems, pp. 53-92, Thesis, Univ. of Illinois at Urbana-Champaign, 1990.

S. W. Lee, "Scattering of Dielectric-Loaded Screen," IEEE Trans. on Antennas and Propagation, vol. AP-19, No. 5, pp. 656-665, Sep., 1971.

E. Parker, S. Hamdy and R. Langley, "Arrays of Concentric Rings as Frequency Selective Surfaces," Electronics Letters, vol. 17, No. 23, p. 881, 1981.

R. J. Langley and E. A. Parker, "Double-Square Frequency-Selective Surfaces and their Equivalent Circuit, " Electronics Letters, vol. 19, No. 17, pp. 675-677, Aug. 1983.

E. A. Parker and J. C. Vardaxoglou, "Plane-wave illumination of concentric-ring frequency-selective surfaces," IEEE Proceedings, vol. 132, Pt. H, No. 3, p. 176, Jun. 1985.

E. A. Parker and J. C. Vardaxoglou, "Influence of single and multiple-layer dielectric substrates on the band spacings available from a concentric ring frequency-selective surface," Int. J. Electronics, vol. 61, No. 3, pp. 291-297, 1986.

*Primary Examiner*—Donald Hajec
*Assistant Examiner*—Tan Ho
*Attorney, Agent, or Firm*—John H. Kusmiss; Thomas H. Jones; Guy M. Miller

[57] ABSTRACT

A multireflector antenna utilizes a frequency-selective surface (FSS) in a subreflector to allow signals in two different RF bands to be selectively reflected back into a main reflector and to allow signals in other RF bands to be transmitted through it to the main reflector for primary focus transmission. A first approach requires only one FSS at the subreflector which may be an array of double-square-loop conductive elements. A second approach uses two FSS's at the subreflector which may be an array of either double-square-loop (DSL) or double-ring (DR). In the case of DR elements, they may be advantageously arranged in a triangular array instead of the rectangular array for the DSL elements.

6 Claims, 8 Drawing Sheets

DOUBLE-LOOP FREQUENCY SELECTIVE SURFACES FOR MULTI FREQUENCY DIVISION MULTIPLEXING IN A DUAL REFLECTOR ANTENNA

ORIGIN OF INVENTION

The invention described herein was made in the performance of work under a NASA contract, and is subject to the provisions of Public Law 96-517 (35 USC 202) in which the contractor has elected not to retain title This application is a continuation, of application Ser. No. 07/909,501, filed Jun. 24, 1992 now abandoned

TECHNICAL FIELD

The invention relates to a frequency selective surface (FSS) designed for reflecting selected signals in different frequency bands, and more particularly to a multireflector antenna, such as a Cassegrain antenna that utilizes one type of FSS for a subreflector to allow signals in two different bands, such as the X and Ka bands, to be selectively reflected back onto a main reflector. The subreflector allows other signals in other frequency bands to be transmitted through it to the main reflector which reflects all frequency signals.

BACKGROUND ART

FSSs with cross-dipole patch elements (also known as "dichroic surfaces") have been used in the subreflector of high-gain Cassegrain antennas for reflecting a signal in the X band and passing a signal in the S band. Cross-dipole patch elements have also been used for the subreflector design of a tracking and data relay satellite system (TDRSS) to diplex the S and Ku band signals. [V. D. Agrawal and W. A. Imbriale, "Design of a Dichroic Cassegrain Subreflector,"*IEEE Trans.*, Vol. AP-27, pp. 466–473, July 1979.]

The characteristics of an FSS utilizing cross-dipole elements changes drastically as the incident angle is steered from normal to 45°. Thus, a large band separation is required to minimize the RF losses for diplex operations. This is evidenced by the reflection and transmission band ratio ($f_r$:$f_t$) being 7:1 for a single screen FSS with cross-dipole elements. [Agrawal, et al., supra] or 4:1 for double screen FSS [G. H. Schennum, "Frequency Selective Surfaces for Multiple Frequency Antennas," *Microwave Journal*, pp. 55–57, May 1973] Better elements, such as the square or loop elements, are definitely required for space missions that require band separation for as many as four adjacent bands.

STATEMENT OF THE INVENTION

In accordance with the present invention, double-loop conductive elements (with square loops or circular loops) are provided in a rectangular array or, in the case of circular loops, a triangular array on a sheet of dielectric material to form a frequency selective surface (FSS) utilized in a subreflector of a dual-reflector antenna for selectively reflecting two signals in different frequency bands, such as the X and Ka bands. The subreflector may either (1) be a frequency selective surface for reflecting signals at selected frequencies in different bands, such as X and Ka bands to the main reflector and passing signals at other frequencies, possibly in different bands to a main reflector, such as the S and Ku bands, or (2) comprise a first frequency-selective surface for reflecting at least one signals at a frequency in a selected band, such as the Ka band, and passing signals at other frequencies possibly in different bands, such as in X, S and Ku bands, and further having a second frequency-selective surface behind the first frequency-selective surface for reflecting a signal passed by the first frequency-selective surface, such as the X band signal, and also passing other signals passed by the first frequency-selective surface, namely the S and Ku band signals in this example. An array of double-loop conductive elements on a sheet of dielectric material is sometimes referred to hereinafter as a "grid."

DETAILED DESCRIPTION OF THE INVENTION

Figure 1:
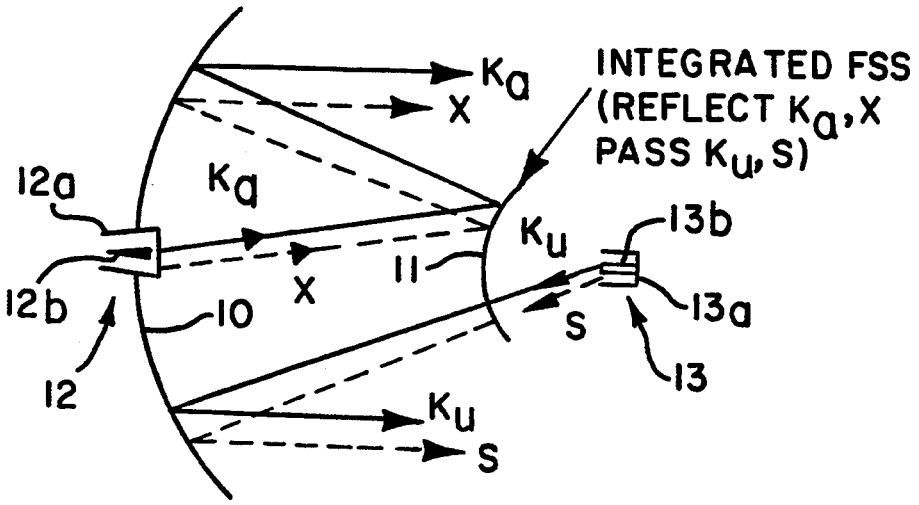
FIG. 1 illustrates an integrated frequency selective surface approach to the present invention in a Cassegrain antenna.

Many space and earth bound antenna applications require the simultaneous use of multiple RF frequencies, such as frequencies selected in S, X, Ku, and Ka bands for space science investigation and data communication links. To meet this multifrequency division multiplexing requirement, one approach is to use a single high-gain Cassegrain antenna as shown in FIG. 1 having a main reflector 10 and one type of frequency-selective surface (FSS) for a subreflector 11 to allow selected X and Ka band frequencies from, for example, a dual polarization feed 12 to be reflected by the FSS subreflector 11 back to the main reflector 10 for transmission, and to allow S and Ku band frequencies from a dual polarization feed 13 to pass through the FSS subreflector 11 to the main reflector 10 for prime focus transmission.

Figure 2:
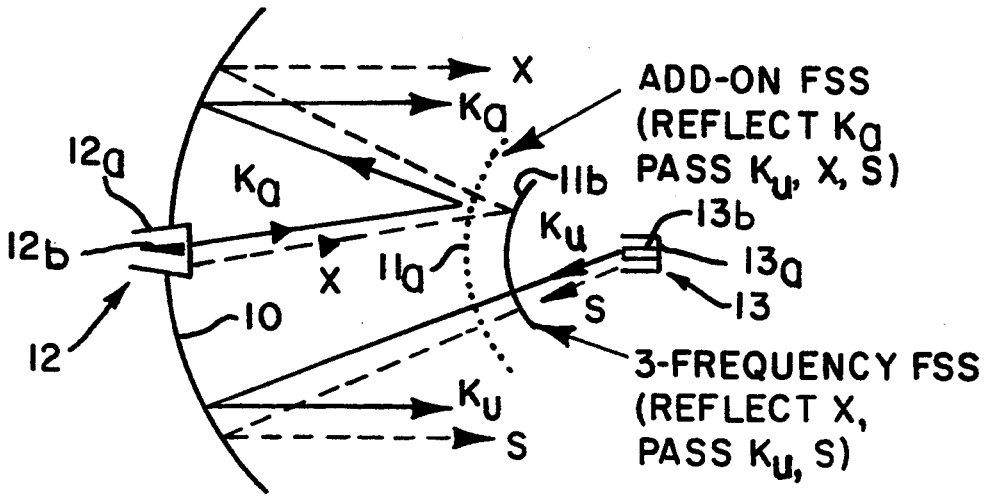
FIG. 2 illustrates an add-on frequency-selective surface approach to the present invention in a Casse-grain antenna.
Figure 3A:
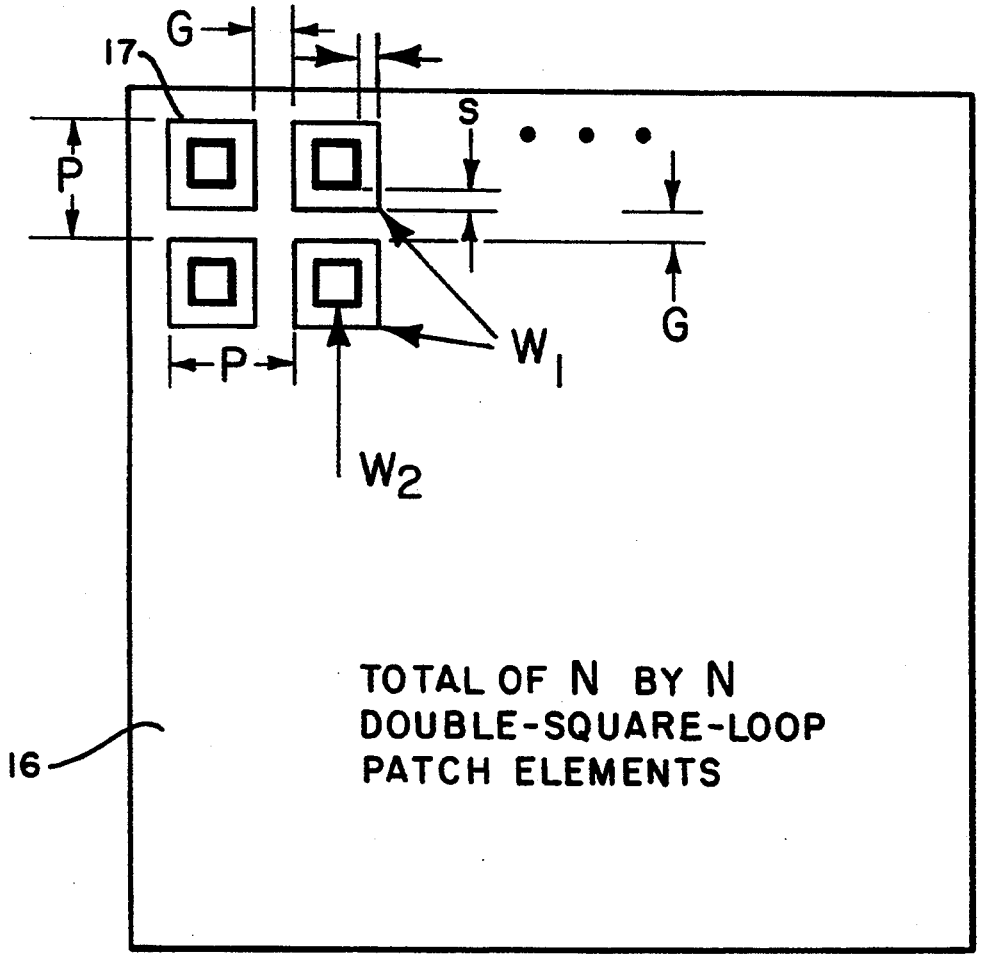
FIG. 3*a* shows in a plan view a flat FSS grid panel used to prove feasibility of a frequency-selective surface (FSS) of a subreflector in the two embodiments of the present invention shown in FIGS. 1 and 2.
Figure 3B:
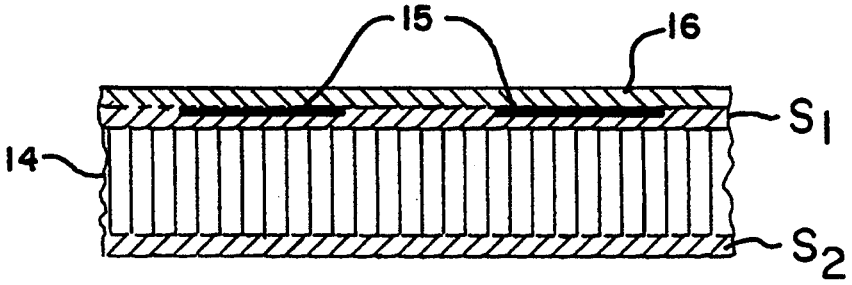
FIG. 3*b* is a cross section taken through a pair of DSL patch elements in FIG. 3*a*.

This first approach utilizes a grid comprising an array of square or circular double-loop conductive elements for the FSS subreflector 11 as illustrated schematically in FIGS. 3*a* and 3*b* for a generic flat FSS test panel. Once the design of the FSS subreflector is completed using a flat test panel, the Casse-grain subreflector can be fabricated in the appropriate hyperbolic shape using the double-loop conductive elements of the FSS test panel. While the main reflector 10 is a conventional dish intended to reflect all incident frequency signals, the subreflector 11 is designed to pass the signals in the S and Ku bands while reflecting signals in the X and Ka bands. The FSS test panel for the subreflector of the embodiment of FIG. 2, or similar to that of the first embodiment of FIG. 1 except for details of design, as will be described below.

Figure 4A:
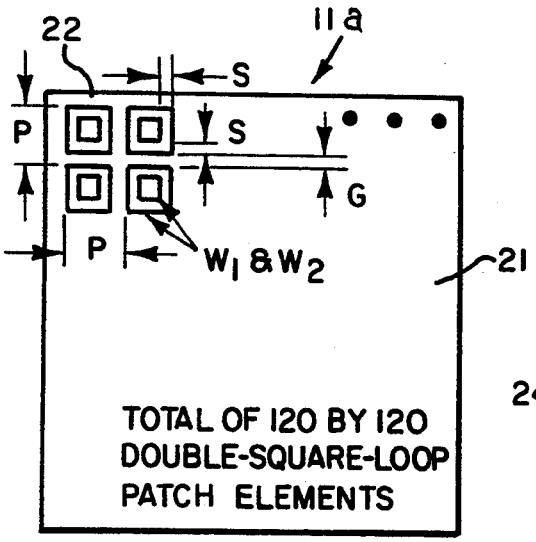
FIGS. 4*a* and 4*b* show in respective top (front) and bottom (back) plan views of a flat FSS grid panel used to prove feasibility of a double FSS grid for the subreflector in the embodiment of FIG. 2.
Figure 4B:
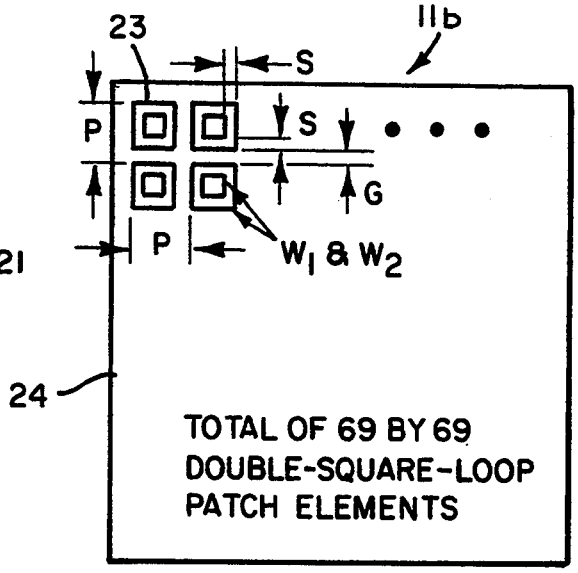
Figure 4C:
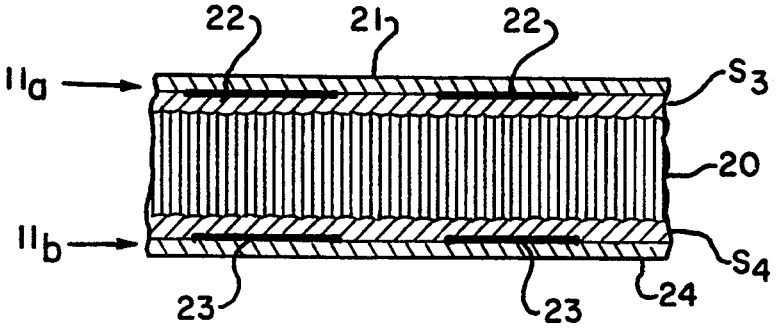
FIG. 4*c* is a cross section taken through a pair of DSL patch elements shown in FIGS. 4*a* and 4*b*.

A second approach shown in FIG. 2, hereinafter referred to as the "add-on" approach, uses two FSS grids 11*a* and 11*b* for the Cassegrain subreflector as shown in FIGS. 4*a*, 4*b* and 4*c*. The FSS grid 11*a* shown in FIG. 4*a* is called the Ka add-on FSS because it is laminated onto a skin $S_3$ on a honeycomb core 20 (a segment of which is shown in a cross section in FIG. 4*c*) in front of the FSS grid 11*b* with the dielectric honeycomb core 20 and dielectric skins $S_3$ and $S_4$ between them. The front FSS grid 11*a* is designed to reflect only the signal at a frequency in the Ka band and pass S, X and Ku band waves. The back FSS grid 11*b* is similar except for details of design to reflect the X band. It is called a three-frequency FSS because it is designed to reflect X band signal waves but passes S and Ku band signal waves, thus allowing for transmission from the main reflector 10 of three frequency-division multiplexed signals plus the transmission of the add-on FSS signal in the Ka band.

The resultant double-grid subreflector comprising grids 11*a* and 11*b* reflects both X and Ka band signal waves from the dual polarization feed 12 which may consist of a feed horn 12*a* for the X band signal and a centered rod antenna 12*b* for the Ka band signal and passes both S and Ku band signal waves from the dual polarization feed 13 for prime focus transmission. This is in contrast to the first approach shown in FIG. 1, hereinafter referred to as the integrated approach, which uses only a single FSS grid for the subreflector 11 to reflect the X and Ka band signal waves from the dual polarization feed 12 for transmission and to pass the S and Ku band signal waves from the dual polarization feed 13 for prime focus transmission. The feed 13 may comprise a cup 13*a* for radiation of the S band signal fed to it in a conventional manner, and a rod or other suitable antenna 13*b* for radiation of the Ku band signal.

The generic flat FSS grid panel shown schematically in a plan view in FIG. 3*a* was first designed and implemented to prove the feasibility of the four-frequency-division multiplexing of both the integrated and the add-on approach shown schematically in FIGS. 1 and 2. A segment of the honeycomb sandwich of this flat FSS grid panel is shown in FIG. 3*b* in a cross section. It comprises dielectric skins $S_1$ and $S_2$ on both sides of a dielectric honeycomb core 14. A grid 15 of double-square-loop (DSL) elements (shown as a heavy line in the cross section view of a segment of the panel shown in FIG. 3*b*) between the skin $S_1$ and a sheet 16 was first etched using a DSL patch element pattern 17 shown in FIG. 3*a* in a thin-film of copper Cu deposited on the sheet 16. Once the grid 15 was etched in the copper film on the sheet 16, the side of the sheet 16 having the etched pattern of double-square-loop elements 17 was bonded onto the skin $S_1$ over the honeycomb core 14.

The double-square-loop element pattern 17 was designed for reflection of two signal frequencies selected, one frequency in each of the two bands X and Ka. An example of a successful design is given hereinbelow for a test panel 20"×20 " having a total of 109×109 DSL patch elements using the following pattern dimensions:

| | | |
|---|---|---|
| Period | P = 0.1732 | Outer Loop Cu Width $W_1$ = 0.0054 |
| Gap | G = 0.0217" | Inner Loop Cu Width $W_2$ = 0.0217 |
| | | Line Spacing S = 0.0217 |

This geometry and configuration of DSL patch elements in a rectangular array (grid) is described more fully below. It is introduced here to present an example of the generic geometry and configuration used in test panels for the design of the add-on approach of FIG. 2.

For the present it should be noted that the subreflector 11 of the embodiment of FIG. 1, is similar to that of FIG. 3*a*, as noted above, and also similar to the FSS grid 11*b* of the subreflector in the embodiment of FIG. 2 in that it passes signals of frequencies in the Ku and S bands and reflects signals in the X band, as well as in the Ka band. Note that FSS grid 11*a* for the embodiment of FIG. 2 is also similar to the grid 11*b* except that it reflects signal waves of a frequency in the Ka band and passes signal waves in the X bands. Examples of successful designs of such similar subreflector grids are given below for each embodiment.

For the add-on approach of FIG. 2, two separate FSS geometries and configurations are required. The first one is a pair of rectangular array of DSL patch elements referred to above and shown in FIGS. 4*a* and 4*b* bonded on a honeycomb sandwich as shown in FIG. 4*c*. A dielectric sheet 21 with an array of etched copper DSL elements 22 shown in FIG. 4*a* is bonded over a skin $S_3$, as shown in FIG. 4*c* for the subreflector 11*a* of FIG. 2, i.e., for reflection of the signal at a selected frequency in the Ka band. An array of etched copper elements 23 on a sheet 24 is similarly bonded on the skin $S_4$ of the sandwich structure for the subreflector 11*b* of FIG. 2, i.e., for reflection of the signal at a selected frequency in the X band and transmission of signals in the Ku and S bands. The difference between the grids of subreflectors 11*a* and 11*b* is that the DSL pattern of the elements 23 in FIG. 4*b* for the subreflector 11*b* is designed to reflect the selected frequency signal in the X band and pass frequency signals in the Ku and S bands, whereas the DSL pattern 22 in FIG. 4*a* for the subreflector 11*a* is designed to reflect the selected frequency signal in the Ka band and pass frequency signals in the Ku and S bands. The net effect of the two grids having the DSL patterns 22 and 23 is the same as the FSS grid of the subreflector 11 of FIGS. 3*a* and 3*b* for the embodiment of FIG. 1 when used as the subreflectors 11*a* and 11*b* in the embodiment of FIG. 2.

The RF performance of the FSS panels is strongly dependent on the dielectric properties of the honeycomb skin materials, i.e., the dielectric constant and the loss tangent of the skins ($S_1$ and $S_2$ in FIG. 3*a* and $S_3$ and $S_4$ in FIG. 4*c*). Therefore, each test panel required different dimensions selected for the wavelength of signals to be reflected by the FSS and the effective dielectric constant of the material supporting the DSL patch elements. The dimensions for each test panel will be given separately.

Dielectric property is known to change from one material to another and even from one production batch to another. Therefore, two or more iterations of panel fabrication and test may be required to derive the optimum FSS grid design for any one skin material production batch. Once that is done for flat panels, it is necessary to form the shape of skin cladded honeycomb core for the desired subreflector (hyperbolic for the Cassegrain antenna of FIG. 1 or FIG. 2) from the same production batch of skin material.

The FSS grid elements tested were double-square-loop and double-circular-loop elements. Both a single and a double sided FSS panel with double-square-loop elements were designed using the integral equation technique described by R. Mittra, C. Chan and T. Cwik, "Techniques for Analyzing Frequency Selective Surfaces—a Review," *IEEE Proceedings*, Vol. 76, No. 23, Page 1593, December 1988, and J. D. Vacchione, "Techniques for Analyzing Planar, Periodic Frequency Selective Surface Systems," Ph.D. Thesis, Univ. of Illinois at Urbana-Champaign, 1990, which by this reference are hereby made a part hereof. The FSS panel with double-circular-loop elements was designed using the integral equation technique developed by S. W. Lee, "Scattering by Dielectric-Loaded Screen," *IEEE Trans.* Vol. AP-19, page 656, September 1971, and E. Parker, S. Hamdy and R. Langley, "Arrays of Concentric Rings as Frequency Selective Surfaces," *Electronic Letters*, Vol. 17, No. 23, page 880, 1981, which by this reference are hereby made a part hereof. The grid design and RF test results are described below.

For each design implemented on 20″×20″ panels, RF tests were performed at room temperature in an anechoic chamber. The tests consisted of the flat panel FSS transmission characteristics measurement and the scattering pattern measurement. The FSS's transmission setup used two standard gain horns as the transmitting and receiving antennas, one on each side of the test panel. By turning the horn antenna's polarization from vertical to horizontal, both TE and TM transmission characteristics of the panel between the two horns were measured.

In principle, this setup should be able to measure the FSS's reflection characteristics. However, erroneous data were obtained due to the strong edge diffractions emanated from the test panel. These troublesome diffractions may be attributed to the horn antenna's large beamwidth and the relatively small FSS panel size. Therefore, to eliminate the edges of the horn antenna beams from the edges of the panel, a precision setup with a horn and a lens may be used on each side of the FSS panel under test for the FSS transmission and reflection measurements. The lens then collimates the feed horn radiation in an area within the borders of the 20″×20″ panel. Nevertheless, a test setup without such lenses gives fairly accurate transmission measurements.

Design and Test Results for Ka Add-on and Three Frequency FSS

The structure of the Ka add-on FSS and three-frequency FSS for the approach illustrated in FIG. 2 are shown in respective FIGS. 4*a* and 4*b*. As was pointed out earlier, this is a double FSS grid approach, with a different array of double-loop elements etched in thin film copper on the two sheets 21 and 24 serving as subreflector FSS grids 11*a* and 11*b* in the embodiment of FIG. 2. The front FSS grid 11*a* shown in FIG. 4*a* is a low-pass FSS that reflects the Ka band and transmits the S, X and Ku bands. The back FSS grid 11*b* shown in FIG. 4*b* is a three-frequency FSS that reflects the X band and transmits the S and Ku bands.

Both double-square-loop (DSL) and double-circular-loop (DCL) elements were studies for this add-on design approach. Predicted and measured RF performances for both DSL and DCL grids are described here to prove the validity of the add-on design approach.

The DSL FSS consists of a double-square-loop copper patch array etched on an electrically thin (1 mil) dielectric substrate (Kapton). However, most of the FSS applications in space require the FSS grids to be imbedded between two dielectric sheets and then supported by a Kevlar honeycomb sandwich core. These dielectric materials are all space qualified materials, and insure that the resultant FSS flight hardware will keep its physical integrity and sustain the mechanical loads in the launch and space environments. In general, the FSS's characteristics are changed significantly when these dielectrics are added to free standing FSS grids in that the dielectric materials tend to lower the FSS's resonant frequency and to stabilize its incident angle dependence. In addition, the RF losses in both the pass and stop bands are increased noticeably because these space qualified materials have relatively high loss tangent. For example, the Kevlar/Epoxy skin has a loss tangent of 0.0156 at X band frequencies, while the Kapton's loss tangent is 0.0028.

Design and Test Results of a Thin DSL 3-Frequency FSS

First, the thin DSL FSS, as shown in FIG. 4*b* without the honeycomb structure of FIG. 4*c*, was designed and fabricated on a 0.001″ thick and 20″ by 20″ sized dielectric sheet (Kapton). The DSL array is periodic and symmetric in both x and y directions with a period P of 0.288 " and a gap G of 0.009 " between any two array elements. The inner and outer loops are separated by a space S of 0.0036" and have the same line width W of 0.009". This DSL FSS is designed to reflect the X band waves (8.4 GHz) and to pass the S band (2.3 GHz) as well as the KU band (13.8 GHz) waves. Transmission performance was calculated by using both equivalent circuit model (ECM) [R. J. Langley and E. A. Parker, "Double-square frequency-selective surfaces and their equivalent circuit, *Electronic Letters*, Vol. 19, No. 17, Page 675, Aug. 18, 1983 ] and the conjugate gradient method (CGM) [R. Mittra, et al., supra] as a function of the incident angle and the polarization. Excellent agreement between the ECM and the CGM computations was observed for the normal incidence case. This implies that, at normal incidence, this thin FSS may be considered as an electrically free-standing grid, even though it is supported by a 0.001" thick dielectric (Kapton) sheet. Note that the resonant frequency of the DSL FSS remains near 8.4 GHz as the incident angle is steered from 0° to 45° for both TE and TM polarizations. This makes the DSL FSS especially superior to the cross-dipole FSS.

Figure 5:
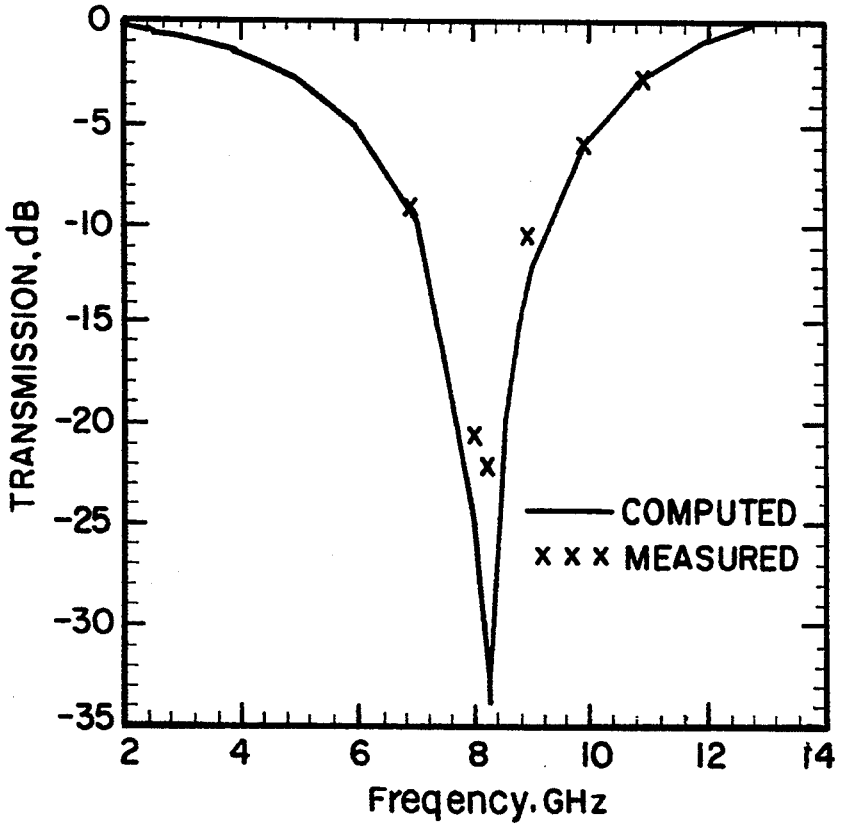
FIG. 5 is a graph of the transmission characteristics of a frequency-selective surface (FSS) for the subreflector 11*b* of FIG. 2 as shown in FIG. 4*b* but without a honeycomb core, i.e., taped for support on rigid but transparent foam with 15° TM incident plane wave.
Figure 6:
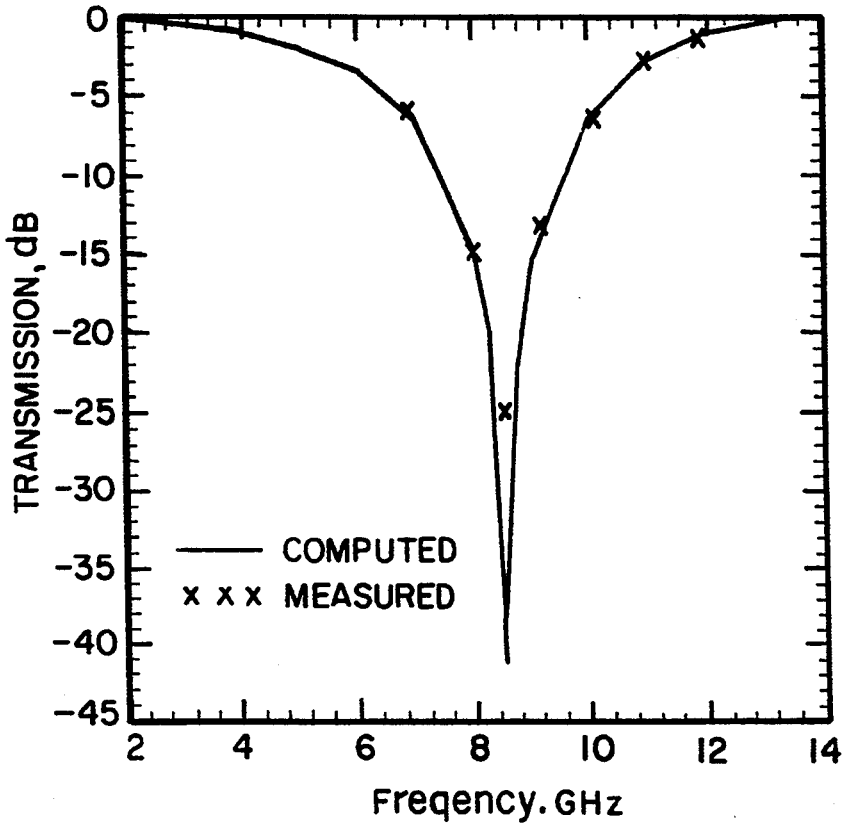
FIG. 6 is a graph of the frequency transparent characteristics of the FSS in the graph of FIG. 5 but with a 40° TM incident plane wave.

Next, the transmission characteristics of this thin DSL FSS were measured in an anechoic chamber. During the measurement of the transmission characteristics, this thin DSL FSS was taped onto a rigid but RF transparent foam, i.e., tested without a honeycomb core. FIG. 5 shows the computed and measured transmission characteristics of the above-mentioned DSL FSS with 15° TM incident plane wave. FIG. 6 shows the transmission performance with 40° TM incident plane wave. The agreement between the measured and calculated data is very good except at the null region. This discrepancy may be attributed to the limited dynamic range of the measurement equipment used at that time. Note in the reflection band (i.e., the null region), the measured results indicate 98.86% of the incident power is reflected (i.e., less than 0.05 dB reflection loss), which is more than adequate.

The calculated loss performance of this DSL FSS at S, X, and Ku bands is summarized in Table 1.

TABLE 1

Computed Loss (dB) Performance for the Thin DSL Three-Frequency FSS

| | | 30° | | 45° | |
|---|---|---|---|---|---|
| f(GHz) | $\theta = 1°$ | TE | TM | TE | TM |
| 2.3 | .35 | .4 | .26 | .48 | .17 |
| 7.2 | .42 | .5 | .73 | .53 | 1.32 |
| 8.4 | .06 | .03 | .01 | .02 | .02 |
| 13.8 | .1 | .18 | .08 | .26 | .07 |

The losses at 2.3 and 13.8 GHz are the transmission losses while the losses at 7.2 and 8.4 GHz are the reflection losses. Note that the reflection losses at 7.2 GHz are much higher than the losses at 8.4 GHz. This is due to the fact that this design is optimized at the 8.4 GHz. Better performance can be achieved at 7.2 GHz but with some performance degradation at other frequencies.

Figure 7:
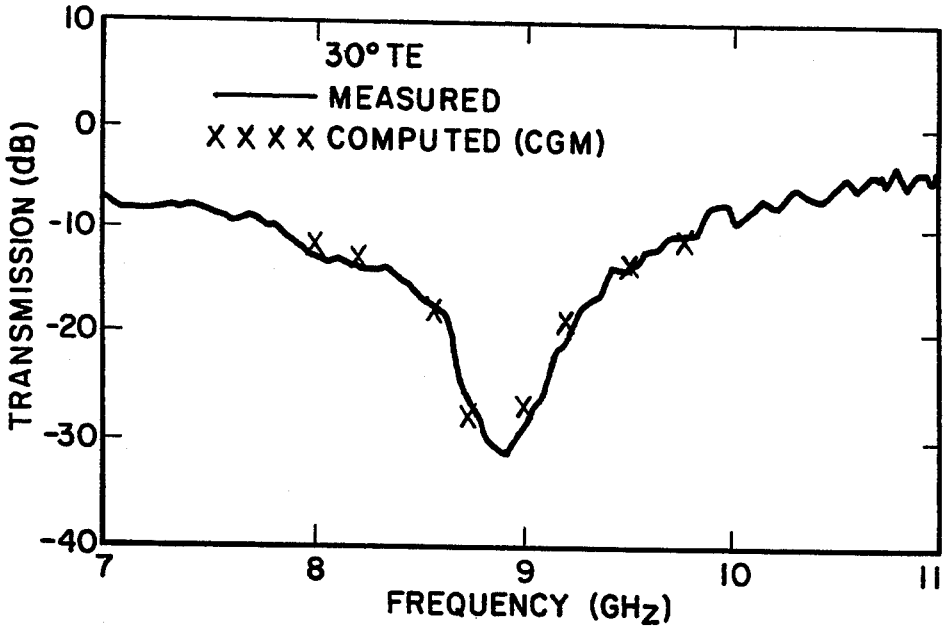
FIG. 7 is a graph of measured and computed transmission performance of the FSS in the graph of FIG. 4*b* but with a honeycomb as shown in FIG. 4*c*.

Design and Test Results of Three-Frequency FSSs with Honeycomb Sandwich Panel As noted above, the FSS grids need to be integrated with rigid and qualified dielectric materials for space projects. Thus, another DSL FSS was designed and fabricated as illustrated in FIG. 4c using a honeycomb sandwich comprising 0.5" thick honeycomb 20 with 12 mil Kevlar skins (3 plies) $S_3$ and $S_4$ structure but with only the three-frequency FSS grid of FIG. 4b etched in thin film copper over 1 mil Kapton sheet on some test panels (and some on 2 mil thick Kapton sheet), and then bonded to the Kevlar skin of the honeycomb structure. The FSS grids have a period of 0.311" and the elements are separated by a gap G=0.039". The inner loop has a line width W of 0.029" and is separated by a 0.0486" space S from the outer loop which has a line width W of 0.0097 ". These grid dimensions were obtained by assuming the dielectric constant of the Kevlar/Epoxy skin is 3.5, as stated by the supplier. But after this DSL FSS with a honeycomb sandwich structure was tested in the anechoic chamber, it was found that the Kevlar-/Epoxy skin's dielectric constant must be 2.35 in order to get the good agreement between the measured and predicted results as shown in FIG. 7. Note that the resonance frequency is near 9 GHz instead of the 8.4 GHz, since the Kevlar/Epoxy skin's dielectric constant is 2.35 instead of 3.5, and the design assumed that the dielectric constant was 3.5.

Figure 8:
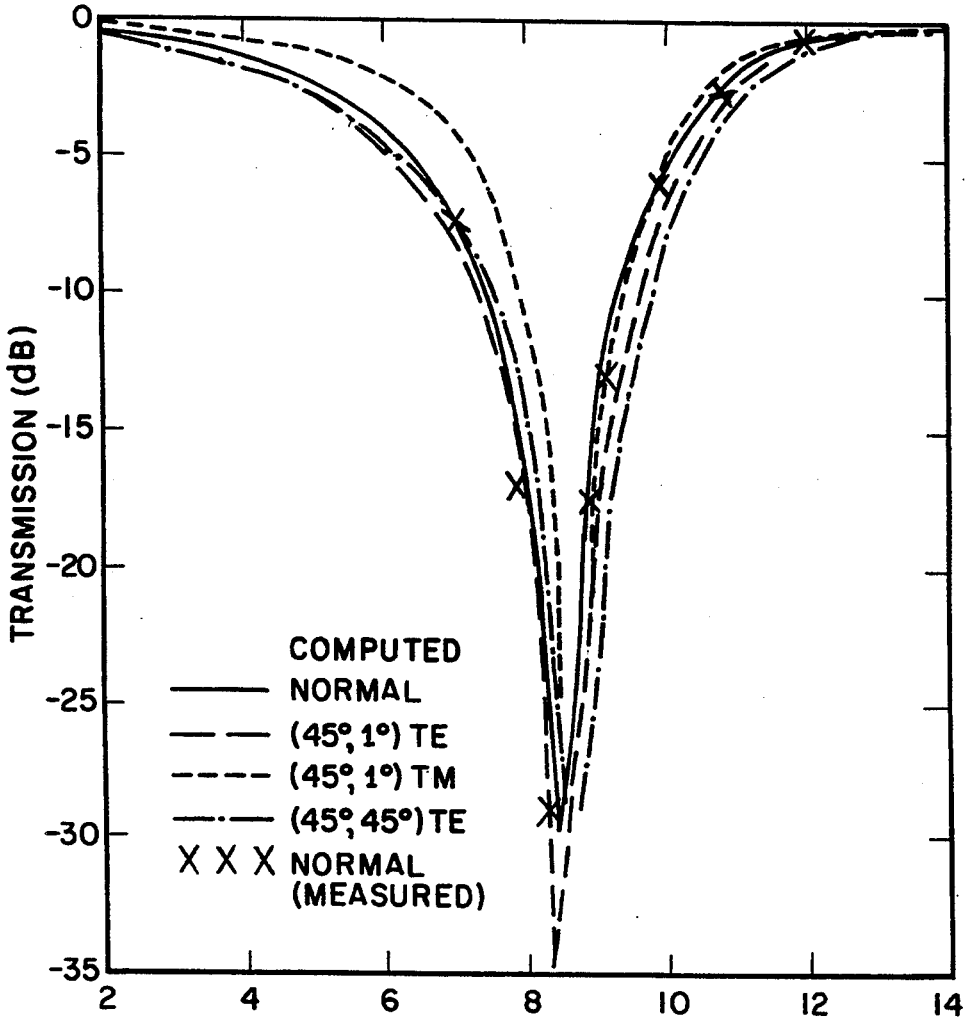
FIG. 8 is a graph of measured and computed transmission performance of the FSS in the graph of FIG. 7 with the same honeycomb as shown in FIG. 4*c* but with all dimensions scaled up by 5.3%.

Next, a new DSL FSS was fabricated with the same honeycomb sandwich panel of FIG. 4c, but all the grid's linear dimensions were scaled up by 5.3%. FIG. 8 shows the predicted and measured transmission performance of the new FSS. Note that the resonant frequency for this new FSS is near 8.4 GHz for incident angles from normal to ($\theta_i,\Phi_i$=45°,45°) and for both TE and TM polarizations. The measured data agrees very well with the predicted data as shown in FIG. 8. Here only the representative normal incidence case is plotted. Table 2 summarizes the calculated loss performance of this scaled up DSL FSS with a Kevlar honeycomb. The losses are higher than the thin screen DSL FSS's losses shown in Table 1. This may be attributed to the relative higher loss tangent of the Kevlar/Epoxy skin material of the honeycomb structure.

TABLE 2

Computed Loss (dB) Performance for the Scaled-up DSL FSS with Kevlar Honeycomb Sandwich Panel

| | | 30° | | 45° | |
|---|---|---|---|---|---|
| f(GHz) | $\theta = 1°$ | TE | TM | TE | TM |
| 2.3 | .38 | .46 | .28 | .58 | .19 |
| 7.2 | .24 | .96 | 1.41 | .8 | 2.1 |
| 8.4 | .1 | .17 | .16 | .15 | .23 |
| 13.8 | .13 | .18 | .12 | .36 | .1 |

Design and Test Results of Ka Add-on and Three-Frequency DSL FSS without Honeycomb FIGS. 4a, 4b, and 4c show the configuration of this dual DSL FSS grid test panel for the add-on approach of the present invention illustrated in FIG. 2 but without the honeycomb 20. Instead a foam spacer was used. It consisted of a Ka add-on FSS grid 11a in FIG. 4a, a three-frequency DSL FSS grid 11 in FIG. 4b and a rigid foam spacer instead of the honeycomb structure between the grids as shown in FIG. 4b. The Ka add-on FSS is a single-screen DSL patch element FSS etched on a 1 mil thick and 20 " by 20 " sized Kapton substrate. This DSL array is periodic and symmetric in both x and y directions with a period P of 0.1575" and a gap G of 0.049". The inner and outer loops are separated with a space S of 0.0197" and they have the same line width W of 0098". This add-on FSS was designed to reflect the Ka band waves and to transmit the S, X and Ku band waves. Therefore, it is also called a low-pass FSS. The three-frequency FSS is described above. The foam spacer was 0.75" thick Rohacell 51-IG foam. In operation, the Ka and X band waves are reflected by the front grid 11*a* and back grid 11*b*, respectively. Both S and Ku band waves will pass through this dual-screen FSS with minimum RF insertion loss, as illustrated in FIG. 2. The RF performance of the three-frequency DSL FSS grid is described above.

The Ka add-on DSL FSS grid was fabricated as described above on a foam spacer and evaluated by comparing computed and measured transmission characteristics at normal and 45° TE incidence. The computed results were obtained for the comparison via the conjugate gradient method (CGM). Excellent agreement between the computed and measured data was observed. It should be noted that by comparing a prior-art FSS having single-square-loop patch elements, the double-square-loop FSS gives sharper transition from the passband at 13.8 GHz to the stopband at 32 GHz.

Figure 10:
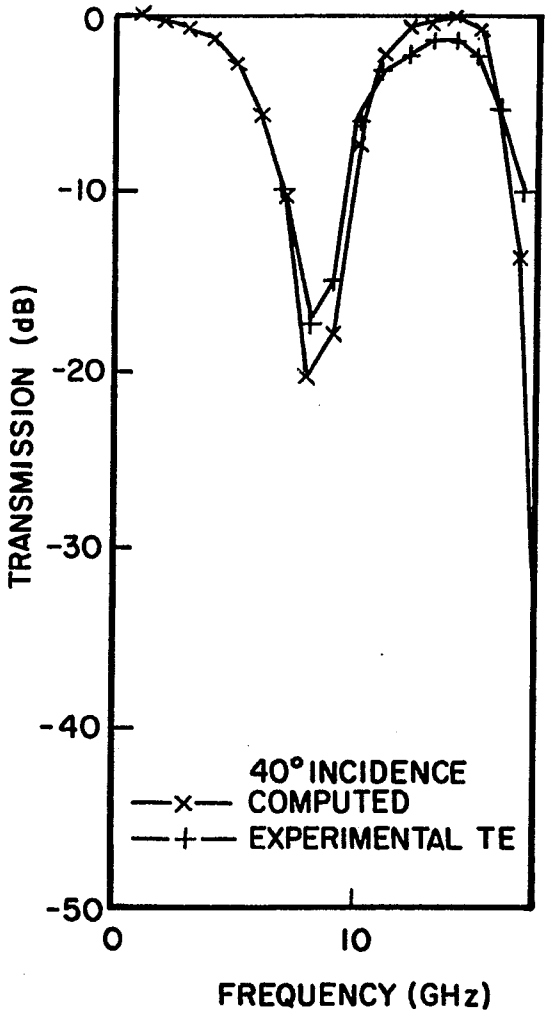
FIG. 10 is a graph of measured and computed transmission characteristics of the FSS in the graph of FIG. 9 but with a 40° TE incident plane wave.
Figure 9:
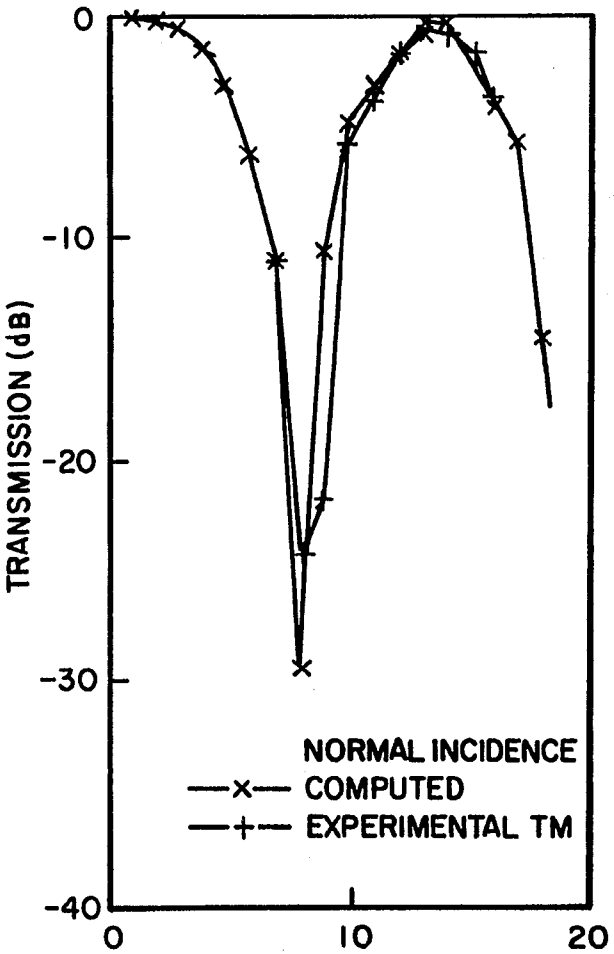
FIG. 9 is a graph of measured and computed transmission characteristics of the FSS for the subreflector grids 11*a* and 11*b* of FIG. 2 as shown in FIGS. 4*a* and 4*b* at normal incidence of a plane wave.

Next the Ka add-on FSS and the three-frequency FSS were assembled together with the foam spacer in place of the honeycomb structure shown in FIG. 4*c* and evaluated as a four-frequency FSS for use as a subreflector in the embodiment of FIG. 2. The predicted and measured transmission performances of this two-grid FSS are shown in FIGS. 9 and 10 for normal and 40° incidence, respectively. The agreement between the measured and computed results is fairly good even though the FSS screens were not etched to ±0.5 mil specification of tolerance. This verified the accuracy of the dual DSL-FSS grid design for the add-on design approach for implementation of the present invention as shown in FIG. 2. The computed loss performance at the four bands (i.e., S, X, Ku, Ka bands) is summarized in Table 3. Note that the losses at 2.3 and 13.8 GHz are the transmission losses while the losses at 7.2, 8.4, 32 and 34 GHz are reflection losses.

TABLE 3

Computed Loss (dB) Performance of the Four-Frequency FSS without Honeycomb

| | | 30° | | 40° | |
|---|---|---|---|---|---|
| f(GHz) | $\theta = 1°$ | TE | TM | TE | TM |
| 2.3 | .42 | .48 | .33 | .55 | .28 |
| 7.2 | .24 | .28 | .44 | .33 | .73 |
| 8.4 | .04 | .01 | .01 | .02 | .03 |
| 13.4 | .46 | .23 | .17 | .23 | .15 |
| 32 | .33 | .2 | .3 | .06 | .27 |
| 34 | .02 | .04 | .03 | .17 | .18 |

Design and Test Results of Ka Add-on and Three-Frequency DSL FSS with Honeycomb The three-frequency FSS design with a Kevlar honeycomb support has been described above. Similarly, the Ka add-on FSS grid may be designed with 12 mil Kevlar skins (3 ply) $S_3$ and $S_4$ over honeycomb 20 for support as shown in FIG. 4*c*. The computed transmission performance for an incident angle steered from normal to 45° and for both TE and TM polarizations have been compared with measured data. Again good agreement was observed. Thus, the accuracy of the subreflector design using the DSL FSS grids 11*a* and 11*b* shown in FIGS. 4*a* and 4*b* in the add-on approach of FIG. 2 is verified.

Figure 13:
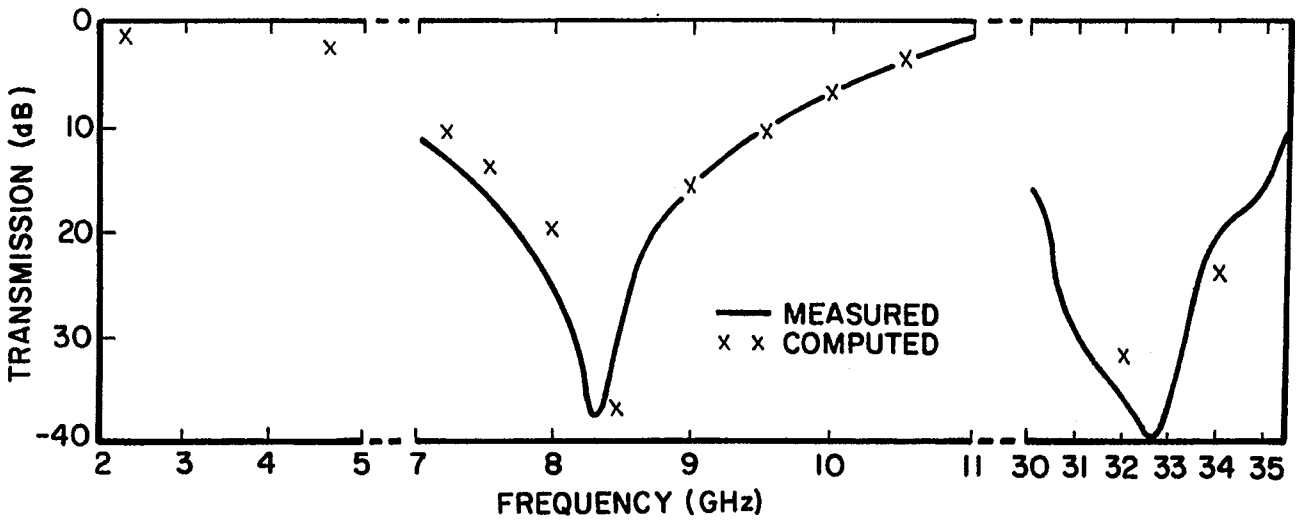
FIG. 13 is a graph of measured and computed performance of the add-on design of the subreflector of FIGS. 4*a*, 4*b* and 4*c* with a honeycomb support structure for the S (computed), X and Ka band signal. The computed and measured points for transmission of the Ku band signal between the X and Ka band signal graphs are not shown since they would be near zero dB, but good agreement was observed. Only computed S band signal data was plotted since measurement for the S band signal would require a test panel larger than the 20"×20" test panels used.

Next, the Ka add-on grid 11*a* and the three-frequency FSS grid 11*b* were both bonded on the top and bottom side of a honeycomb structure as shown in FIG. 4*c*. That structure also gave good agreement between computed and measured transmission performances of this add-on approach, as shown in FIG. 13, although no S band measured data was obtained for comparison of the S band in the left of FIG. 13, since measurement for that S band frequency requires a much larger panel than the test 20" by 20" panel fabricated and tested. And also note that in the graphs of FIG. 13, the reflected X band signal is shown in the center graph while the reflected Ka band signal is shown in the graph at the right. The passed (transmitted) Ku band signal between the second and third graph is not plotted since it would consist of plotted points near zero dB as in the case of the plotted points for the S computed band signal transmission. Nevertheless, since the accuracy of the DSL FSS design checked out thoroughly with measurements at higher frequencies, it should check out for the S band as well using a larger grid panel. The computed RF loss performance for this double DSL FSS grid is summarized in Table 4. The losses are higher than for the two DSL FSS grids without the Kevlar honeycomb as indicated in Table 3. This is due to the relatively higher loss tangent of the Kevlar/Epoxy skin material of the honeycob structure.

TABLE 4

Computed Loss Summary of the Ka Add-on and Three-Frequency FSS with Kevlar Honeycomb Sandwich Panel

| | | (dB/Degree) | | | |
|---|---|---|---|---|---|
| | | 30° | | 45° | |
| Frequency (GHz) | $\theta = 1°$ | TE | TM | TE | TM |
| 2.3 | .41/21 | .5/23 | .33/20 | .68/25 | .23/16 |
| 7.2 | .65/−75 | .73/−56 | 1.1/−43 | .85/−32 | 1.95/4.7 |
| 8.4 | .14/−118 | .17/−99 | .19/−92 | .22/−80 | .29/−55 |
| 13.8 | 1.1/44 | 1.2/49 | .73/43 | 2.1/66 | .53/40 |
| 32 | .53/−178 | .19/−178 | .22/−176 | .21/−179 | .48/−174 |
| 34 | .21/171 | .28/170 | .33/170 | .20/172 | .30/168 |

Design and Test Results of Ka Add-on FSS with Double-Ring (Circular Loop) Element The mode analysis of a single grid FSS with a double ring element was presented by E. A. Parker and J. C. Vardaxoglou, 37 Plane-wave illumination of concentric-ring frequency-selective surfaces," *IEE Proceedings*, Vol. 132, Pt. H, No. 3, p. 176, June 1985 and E. A. Parker and J. C. Vardaxoglou, "Influence of single and multiple-layer dielectric substrates on the band spacings available from a concentric ring frequency-selective surface," *Int. J. Electronics*, Vol. 61, No. 3, pp. 291–297, 1986. However, their analysis was limited to thin rings with dielectric substrates on one side of the grid. The accurate modal analysis for a single multiple-ring patch element grid FSS with a layer of dielectric on both sides of the grid is similar to the multiple-square-loop element grid. A first design fabricated and tested was with multiple-ring FSS elements in an array with small ring width based on a thin wire approximation (i.e., no radial variation for the expansion function of the ring current). The second design was not so limited. It was based on exact coaxial waveguide modal analysis. Both designs can be analyzed with one ring or multiple concentric rings as the element of an FSS. It has been determined that a double-ring (DR) FSS element gives the best RF performance to meet space requirements.

A single FSS grid comprising a rectangular array with single-ring elements was fabricated on a 3 mil thick Kapton. The single-circular-loop FSS array was etched on a 3 mil Kapton substrate with a width of the ring only 2 mil. Good agreement between the computed and measured transmission performance of this FSS grid was found.

Next, rectangular arrays of both single-ring elements and double-ring elements were fabricated for FSS testing (both with a Kevlar honeycomb support) and compared to determine the optimum ring FSS design. Comparison of the single-ring and the double-ring element FSS showed that the double-ring element FSS has much sharper transition from passband to stop band. The resonant frequency of the double-ring element FSS is shifted down when the inner ring is added to the same sized single-ring element FSS. By reducing the double-ring element's size, the double-ring element FSS has the same resonant frequency as the single-ring FSS. However, the losses at Ku and X bands are much smaller than the single-ring FSS. Therefore, the double-ring FSS should give better performance in a lowpass FSS design.

Figure 11:
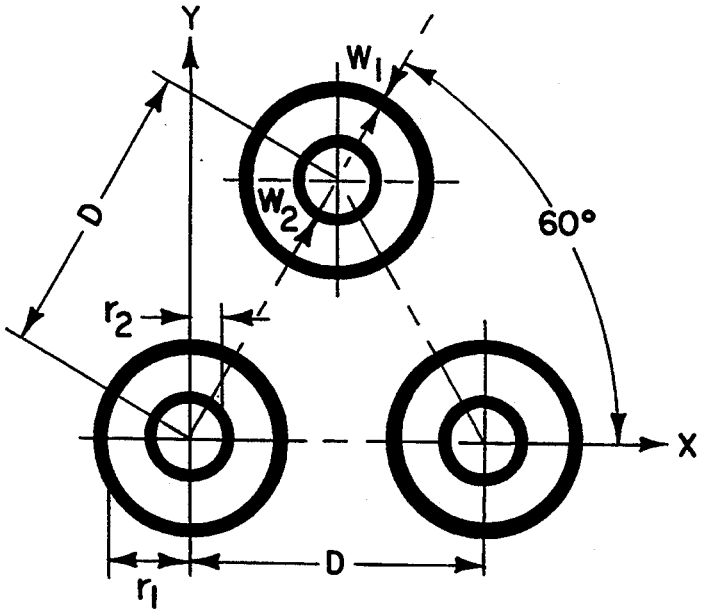
FIG. 11 illustrates double-ring elements arranged in an equilateral triangle which, in an array of many such elements, forms a triangular lattice for a frequency-selective surface used in the add-on approach illustrated in FIG. 2.

Computed transmission performance of a square-lattice ring element FSS for incident angle steered from normal to 45° shifts the resonant frequency about 1.5 GHz. Better performance can be obtained from a double-ring element FSS with a triangular lattice instead of a rectangular lattice, i.e., with elements of an array arranged to form three sets of parallel lines, each set at a 60° angle from the other two sets as shown in FIG. 11, where distance D between ring centers is 0.169" the outer ring radius $r_1=0.042''$, the inner ring radius $r_2=0.023''$ and the ring widths $W_1$ and $W_2$ both equal 0.01". This new FSS's resonant frequency shifted only about 1 GHz as the incident angle varied from normal to 45°.

Design/Analysis of a Three-Frequency FSS with Double-Ring Element

The computed transmission characteristics of a three-frequency double-ring FSS in a triangular lattice as shown in FIG. 11 supported with a Kevlar honeycomb indicated that the resonant frequency is near the designated 8.45 GHz even when the incident angle is changed from normal to 45°. The dimensions and spacing of the double-ring elements were as follows:

$D=28''$
$r_1=0.132''$
$r_2=0.0866''$
$w_1=0.005''$
$w_2=0.008''$

The RF losses are summarized in Table 5.

TABLE 5

Computed Loss Summary of the Three-Frequency FSS with Double-Ring Element

| | | 30° | | 45° | |
|---|---|---|---|---|---|
| f(GHz) | 1° | TE | TM | TE | TM |
| 2.0 | 0.5 | .57 | .4 | .72 | .27 |
| 7.0 | .25 | .5 | .61 | .46 | 1.0 |
| 8.5 | .14 | .12 | .16 | .11 | .17 |
| 14.0 | .26 | .29 | .28 | .36 | .24 |

The losses at S and Ku band are also kept as minimum as possible. By comparing with the double-square-loop (DSL) FSS results presented above, there is hardly any difference between them. In other words, the square-loop or circular-loop (ring) element FSSs give essentially the same performance. However, this is not true for the integrated four-frequency design approach of FIG. 1, as described below.

Design and Test Results of a Four-Frequency Integrated FSS

As noted with reference to FIGS. 3*a* and 3*b*, this design approach has only one FSS grid in both the main and the subreflector. This approach is different from the add-on design approach in that only one FSS grid instead of two is required in the subreflector 11 to reflect both the X and Ka band waves. To avoid grating lobe, the four-frequency integrated FSS was etched in copper on a 10 mil thick Duroid 6010.5 substrate. The substrate has a dielectric constant of 11 to 12 and the loss tangent is 0.0028. Both the multiple-square-loop and the multiple-ring (circular-loop) element FSSs were studied extensively. It was found that the double-square-loop (DSL) FSS gives the best results. In the following paragraphs, both the DSL FSS and the double-ring (DR) FSS designs and results are presented.

Double-Square-Loop Element FSS

Figure 12:
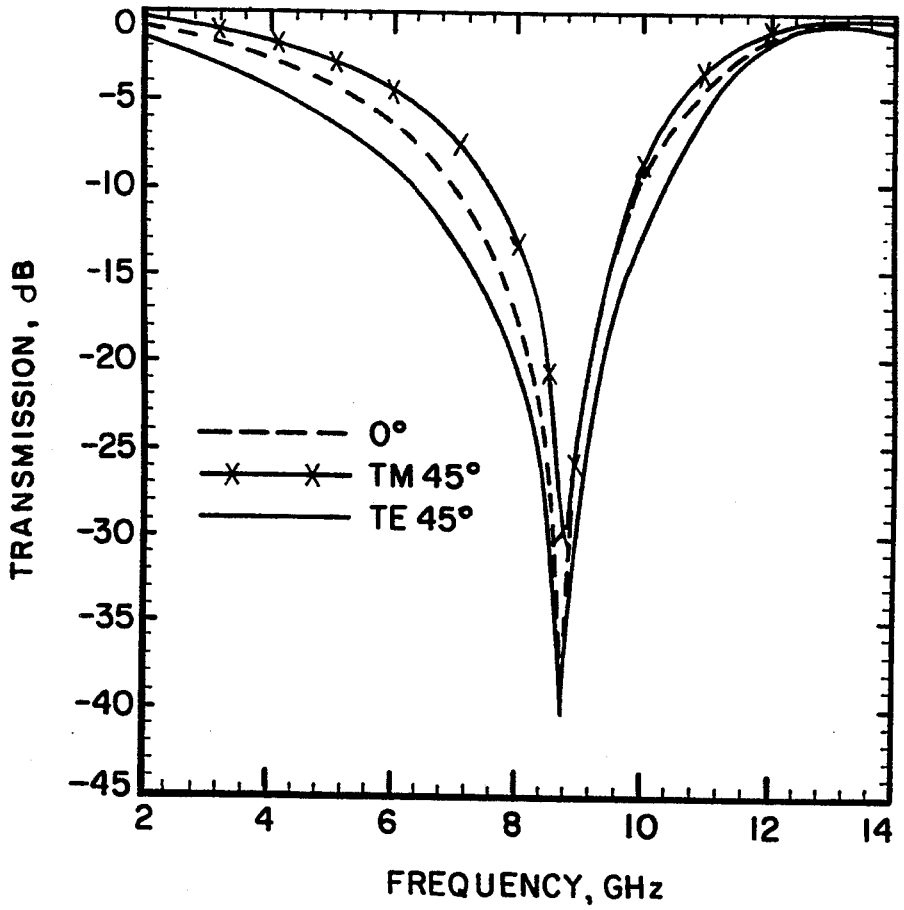
FIG. 12 is a graph which shows the computed transmission characteristics of a double-square-loop frequency-selective surface for the subreflector of the integrated approach of FIG. 1 at X and Ku bands for incident angles steered from normal to 45°.
Figure 14:
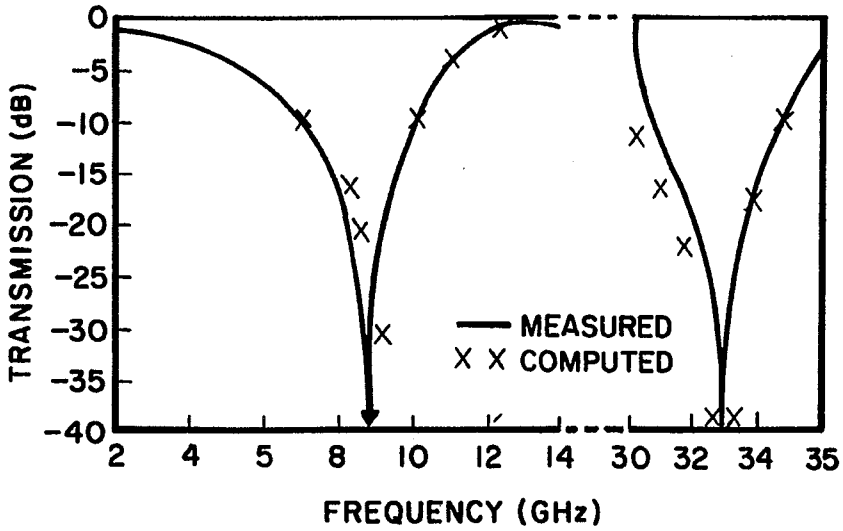
FIG. 14 is a graph of measured and computed performance of the integrated design of the subreflector in the embodiment of FIG. 1. Good agreement is shown.

The geometry of the DSL four-frequency integrated FSS is shown in a plan view in FIG. 3*a*. It is supported with a Kevlar honeycomb core as shown in FIG. 3*b*. The computed transmission characteristics of this DSL FSS at X and Ku bands for incident angles steered from normal to 45° is shown in FIG. 12. The resonant frequency is very stable with respect to the incident angle variation and is right at the design frequency, i.e., 8.45 GHz. There was very good agreement between measured and computed transmission performance for normal (zero degree) incidence and both TE and TM incidence at 30°. Very good agreement was found between the measured and computed results at Ka band, as shown in FIG. 14. This verified the four-frequency integrated design shown in FIG. 3*a* where $P=0.1732''$ $G=0.0217''$, spacing $S=0.0217''$, outer loop Cu width $W_1=0.0054''$, and inner loop Cu width $W_2=0.0217''$. Table 6 summarizes the computed RF loss performance of this DSL FSS. Comparing to the add-on design, the four-frequency integrated design has less RF loss and the phase performance is better.

TABLE 6

Computed Loss Summary of the Four-Frequency FSS with Honeycomb

| | | (dB/Degree) | | | |
|---|---|---|---|---|---|
| | | 30° | | 45° | |
| Frequency (GHz) | 1° | TE | TM | TE | TM |
| 2.3 | .95/−28 | 1.2/−30 | .73/−24 | 1.6/−34 | .5/−20 |
| 7.2 | .45/−167 | .37/−168 | .61/−165 | .27/−170 | .9/−160 |
| 8.4 | .08/180 | .07/180 | .11/180 | .06/180 | .16/179 |
| 13.8 | .37/−23 | .56/−26 | .29/−22 | .9/−29 | .2/−20 |
| 32 | 0.9/161 | .17/168 | .13/160 | .16/172 | .69/163 |
| 34 | .14/149 | .2/152 | .21/143 | .13/159 | .43/133 |

Although particular embodiments of the invention have been described and illustrated herein, it is recognized that modifications and equivalents may readily occur to those skilled in the art. For example, the invention defined by the claims that follow may be practiced with any set of RF bands, including a set in which all signals are selected from among adjacent bands instead of some from alternate bands of the frequency spectrum as in the example described above, and in fact the three or four signals multiplexed may be selected from one or two bands, i.e., they need not be selected from three or four separate bands; it is sufficient that the frequencies selected be sufficiently separated for the design of the frequency selective surfaces to separate the signals by theoretical or empirical adjustment of the dimensions of the period of the elements, the gap between elements, the length of the loop sides, i.e., the size of the loops, the width of the loop lines, all of which together with the effective dielectric constant of the support sheet have some effect on loop resonance for a given signal wavelength. And, although a dual reflector antenna has been disclosed in a Cassegrain configuration, it may be in other configurations including configurations that employ three or more reflectors, including flat reflectors, in which case the present invention defined by the claims may be but a subcombination of the total multireflector antenna. Consequently, it is intended that the claims be interpreted to cover such modifications, equivalents and subcombinations.

I claim:

1. A dual-reflector system for frequency division multiplexing of four signals, each in a separate one of four radio-frequency bands comprising first and second radio-frequency signal reflectors facing each other, said second radio-frequency signal reflector having double-loop conductive elements arrayed for selective reflection of two signals in two separate radio-frequency bands, first and second feed systems, each feed system for transmission of a different selected set of two of said radio-frequency signals in separate radio-frequency bands, said second radio-frequency signal reflector having said arrayed double-loop conductive elements chosen for passing said two signals in different radio-frequency bands from said first feed system through said second radio-frequency signal reflector in a direction toward said first radio-frequency signal reflector, and for reflecting said two radio-frequency signals from said second feed system protruding through said first radio-frequency signal reflector back to said first radio-frequency signal reflector, said first radio-frequency signal reflector being chosen to reflect all of said sets of two radio-frequency signals from said first and second feed systems for transmission of said radio-frequency signals from said first feed system and said radio-frequency signal from said second feed system, wherein said arrayed double-loop conductive elements of said second radio-frequency signal reflector comprises a plurality of double-loop conductive elements on a dielectric sheet of known dielectric constant arranged to form at least one grid of elements, and dimensions of said double-loop conductive elements of said frequency-selective surface of said second radio-frequency signal reflector being chosen for passing said two signals in separate radio-frequency bands transmitted said first feed system and selective reflection of signals transmitted in separate radio-frequency bands by said second feed system.

2. A dual-reflector system as defined in claim 1 wherein said arrayed double-loop conductive elements of said second reflector comprise first and second grids of double-loop conductive elements being positioned to receive direct radiation of said two radio-frequency signals transmitted by said second feed system, and dimensions of said first grid of double-loop conductive elements of said second radio-frequency signal reflector are chosen for selective reflection of one of said two radio-frequency signals in separate radio-frequency bands transmitted by said second feed system while passing the other of said two radio-frequency signals in separate radio-freguency bands transmitted by said second feed system, and for also passing said radio-frequency signals in separate radio-frequency bands transmitted by said first feed system to said first radio-frequency signal reflector, and dimensions of said second grid of double-loop conductive elements of said second radio-frequency signal reflector are chosen for selective reflection of a second one of said two radio-frequency signals in separate radio-frequency bands transmitted by said second feed system.

3. A dual-reflector system as defined in claim 2 wherein said double-loop conductive elements of said first and second grids of said second radio-frequency signal reflector are circular-loop elements.

4. A dual-reflector system as defined in claim 2 wherein said double-loop conductive elements of said first and second grids of said second radio-frequency signal reflector are circular-loop conductive elements.

5. A dual-reflector system as defined in claim 4 wherein said circular-loop conductive elements are arranged in a triangular array such that the distances of every circular-loop conductive element of said grid to adjacent circular-loop conductive elements are equal and therefore each circular-loop conductive element forms with two adjacent circular-loop conductive elements an equilateral triangle.

6. A dual-reflector system as defined in claim 1 wherein said frequency-selective surface of said second radio-frequency reflector comprises a grid of double-square-loop conductive elements on said sheet of known dielectric constant, said double-square-loop conductive elements being designed as to dimensions and spacing on said sheet of known dielectric constant to receive and reflect direct radiation of said two radio-frequency signals transmitted by said second feed systems while passing any radio-frequency signal transmitted by said first feed system.

* * * * *